United States Patent [19]

Iwakura et al.

[11] Patent Number: 4,583,104

[45] Date of Patent: Apr. 15, 1986

[54] RECORDING MATERIALS

[75] Inventors: Ken Iwakura; Masato Satomura, both of Kanagawa; Takekatsu Sugiyama, Shizuoka, all of Japan

[73] Assignee: Fuji Photo Film Co., Ltd., Kanagawa, Japan

[21] Appl. No.: 647,491

[22] Filed: Sep. 5, 1984

[30] Foreign Application Priority Data

Sep. 5, 1983 [JP] Japan ..... 58-162936

[51] Int. Cl.[4] ..... B41M 5/16; B41M 5/18; B41M 5/22

[52] U.S. Cl. ..... 346/216; 346/225; 427/150; 427/151

[58] Field of Search ..... 346/216, 217, 225; 427/150, 151, 152

[56] References Cited

U.S. PATENT DOCUMENTS

| | | | |
|---|---|---|---|
| 4,312,522 | 1/1982 | Yamaguchi et al. | 346/216 |
| 4,446,209 | 5/1984 | Iwakura et al. | 346/216 |
| 4,453,744 | 6/1984 | Würmli et al. | 346/216 |

FOREIGN PATENT DOCUMENTS

| | | | |
|---|---|---|---|
| 0072499 | 4/1983 | Japan | 346/225 |

*Primary Examiner*—Bruce H. Hess

*Attorney, Agent, or Firm*—Sughrue, Mion, Zinn, MacPeak and Seas

[57] ABSTRACT

A recording material composed of an electron donating colorless dye and electron accepting compound is disclosed. The electron accepting compound is a phenol or naphthol compound having, as a substituent, an aryloxysulfonyl group which can be substituted or an alkoxysulfonyl group which can be substituted. The resulting material provides sufficient color density and strong color fastness by coloration reaction.

2 Claims, No Drawings

RECORDING MATERIALS

FIELD OF THE INVENTION

The present invention relates to a recording material, and more particularly, relates to a recording material using a color reaction of an electron donating colorless dye and an electron accepting compound.

BACKGROUND OF THE INVENTION

It is disclosed in Japanese Patent Publication Nos. 9,309/65, 14,039/70 and 29,830/76 that a phenol compound is used as an electron accepting compound for pressure-sensitive recording materials and heat-sensitive recording materials. However, the phenol compound is not sufficient for the electron accepting compound, because color density of images is not high and color fasteness of images to light, humidity, etc. is not sufficient where it is used in combination with an electron donating colorless dye.

A well-known sulfon compound causes fog which means color formation without pressure or heat. For example, bisphenol S provides more fog by humidity because it is more water-soluble. A hydroxydiphenylsulfon compound as disclosed in Japanese Patent Publication (unexamined) No. 210,886/82 is not satisfactory electron accepting compound because it provides more fog due to water-solubility.

SUMMARY OF THE INVENTION

Therefore, an object of the invention is to provide a recording material which can provide sufficient color density where an electron accepting compound is used with an electron donating colorless dye.

Another object of the invention is to provide a recording material which can form color dye having strong color fastness where an electron accepting compound is used with an electron donating colorless dye.

A still another object of the invention is to provide a recording material using an excellent electron accepting compound which can form color dye having sufficient color density and strong color fastness by reaction with an electron donating colorless dye.

The above objects of the invention can be accomplished by a recording material using a phenol or naphthol compound having, as a substituent, an aryloxysulfonyl group which can have a substituent or an alkoxysulfonyl group which can have a substituent as an electron accepting compound which can form color dye in combination with an electron donating colorless dye.

DETAILED DESCRIPTION OF THE INVENTION

The electron accepting compound of the invention is preferably represented by the following formula (I) or (II).

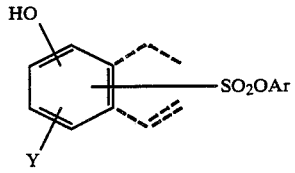

(I)

-continued

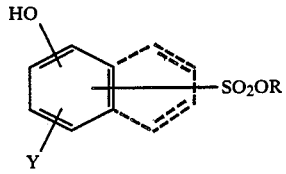

(II)

wherein Y is a hydrogen atom, an alkyl group, an aryl group, a halogen atom or an electron attracting group such as

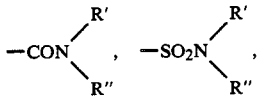

—COR''', —$CO_2$R''', —$SO_2$R''' or —CN in which R', R'' and R''' each is a hydrogen atom, an alkyl group, an aralkyl group or an aryl group, Ar is a phenyl or naphthyl group which can be substituted and R is an alkyl or aralkyl group which can be substituted, and an romatic ring substituted with a hydroxyl group can be a benzene ring or a naphthalene ring.

In the formula (I) or (II) of the invention, the substituent Y is preferably a hydrogen atom, an alkyl group having 1 to 8 carbon atoms, an aralkyl group having 7 to 12 carbon atoms, an aryl group having 6 to 12 carbon atoms, a chlorine atom, a bromine atom and an electron attracting group having not more than 18 carbon atoms, and more preferably a hydrogen atom, an alkyl group having 1 to 4 carbon atoms, an aralkyl group having 7 to 9 carbon atoms, an aryl group having 6 to 9 carbon atoms, a chlorine atom, an acyl group having 1 to 8 carbon atoms, a substituted carbamoyl group having 2 to 9 carbon atoms, a sulfonyl group having 1 to 8 carbon atoms and a substituted sulfamoyl group having 1 to 8 carbon atoms.

The group Ar is preferably a phenyl group, a naphthyl group and a phenyl or naphthyl group substituted with an alkyl group having 1 to 8 carbon atoms, an alkoxyl group having 1 to 8 carbon atoms, a chlorine atom, a bromine atom, a hydroxyl group or an electron attracting group having 1 to 8 carbon atoms, and more preferably a phenyl group, a naphthyl group and a phenyl or naphthyl group substituted with an alkyl group having 1 to 4 carbon atoms, a chlorine atom, an alkoxy group having 1 to 4 carbon atoms, a hydroxy group, an acyl group having 1 to 8 carbon atoms, a substituted carbamoyl group having 2 to 9 carbon atoms, a sulfonyl group having 1 to 8 carbon atoms and a substituted sulfamoyl group having 1 to 8 carbon atoms.

The group R is preferably an alkyl group; an aralkyl group; an alkyl group substituted with an alkoxy group having 1 to 8 carbon atoms, an aryloxy group having 1 to 8 carbon atoms or a halogen atom; and an aralkyl group substituted with an alkyl group having 1 to 8 carbon atoms, an alkoxy group having 1 to 8 carbon atoms, an aryloxy group having 1 to 8 carbon atoms, a halogen atom or an electron attracting group having not more than 18 carbon atoms, and more preferably an alkyl group; an aralkyl group; an alkyl group substituted with an alkoxy group having 1 to 4 carbon atoms, a phenoxy group or a chlorine atom; and an aralkyl group substituted with an alkyl group having 1 to 4 carbon atoms, an alkoxy group having 1 to 4 carbon atoms, a phenoxy group, a chlorine atom, an acyl group having 1 to 8 carbon atoms, a substituted carbamoyl group having 2 to 9 carbon atoms, a substituted sulfonyl group having 1 to 8 carbon atoms or a substituted sulfamoyl group having 1 to 8 carbon atoms.

The preferred electron accepting compounds of the invention are those in which an oxysulfonyl group is attached in the conjugative position to a hydroxyl group.

The preferred electron accepting compound is represented by the followwing formula (III)

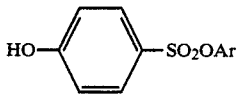

wherein Ar is a phenyl or naphthyl group which can be substituted with an alkyl group having 1 to 4 carbon atoms, a chlorine atom, an alkoxy group having 1 to 4 carbon atoms, a hydroxy group, an acyl group having 1 to 8 carbon atoms, a substituted carbamoyl group having 2 to 9 carbon atoms, a sulfonyl group having 1 to 8 carbon atoms and a substituted sulfamoyl group having 1 to 8 carbon atoms.

An electron accepting compound of the invention has preferably a melting point of not lower than 50° C., more preferably a melting point of 70° to 200° C., where it is used as an electron accepting compound for heat-sensitive recording materials.

The electron accepting compound of the invention can provide the following advantages, (1) Formation of color images having high color density in combination with an electron donating colorless dye,
(2) Formation of stable color images having strong fastness to humidity and light with the passage of time.
(3) Less water-soluble
(4) No sublimation
(5) Easily synthesized with high purity and in high yield, and inexpensive cost of starting materials.

The typical examples of the electron accepting compounds in the invention are shown below, but the invention should not be limited to these examples.

(1) 4-β-naphthyloxysulfonylphenol
(2) 4-α-naphthyloxysulfonylphenol
(3) 4-p-tert-butylphenoxysulfonylphenol
(4) 4-p-isopropylphenoxysulfonylphenol
(5) 4-p-tolyloxysulfonylphenol
(6) 4-octyloxysulfonylphenol
(7) 4-benzyloxysulfonylphenol
(8) 4-p-cumyloxysulfonylphenol
(9) 2-chloro-4-β-naphthyloxysulfonylphenol
(10) 4-phenoxysulfonyl-1-naphthol
(11) 4-p-tert-butylphenoxysulfonyl-1-naphthol
(12) 4-p-isopropylphenoxysulfonyl-1-naphthol
(13) 4-p-tolyloxysulfonyl-1-naphthol
(14) 4-α-naphthyloxysulfonyl-1-naphthol
(15) 4-benzyloxysulfonyl-1-naphthol
(16) 4-hexyloxysulfonyl-1-naphthol
(17) 6-p-isopropylphenoxysulfonyl-2-naphthol
(18) 6-p-tolyloxysulfonyl-2-naphthol
(19) 6-benzyloxysulfonyl-2-naphthol
(20) 5-p-iopropylphenoxyulfonyl-1-naphthol
(21) 5-p-tolyloxysulfonyl-1-naphthol
(22) 5-benzyloxysulfonyl-1-naphthol
(23) 8-p-isopropylphenoxysulfonyl-2-naphthol
(24) 8-p-tolyloxysulfonyl-2-naphthol
(25) 8-benzyloxysulfonyl-2-naphthol, etc.

These are used alone or in combination, or in combination with other electron accepting compounds such as bisphenol A, benzyl 4-hydroxybenzoate, etc.

An electron accepting compound of the invention can by synthesized by well known methods, for example, by reaction of a halogenated sulfonyl compound and an alcohol or phenol compound in the presence of a deacid agent, as described in *The Journal of the Organic Chemistry,* vol. 9, page 235 (1944) and *Beilsteins Handbuch der Organischen Chemie El,* vol. 12, page 434.

An electron donating colorless dye used in the invention can include a triarylmethane compound, a diphenylmethane compound, a xanthene compound, a thiazine compound and a spiropyrane compound. For example, there are triarylmethane compounds such as 3,3-bis(p-dimethylaminophenyl)-6-dimethylaminophthalide, i.e. Crystal Violet Lactone, 3,3-bis(p-dimethylaminophenyl)phthalide, 3-(p-dimethylaminophenyl)-3-(1,3-dimethylindole-3-yl)phthalide or 3-(p-dimethylaminophenyl)-3-(2-methylindole-3-yl)phthalide; diphenylmethane compounds such as 4,4'-bis-dimethylaminobenzhydrinebenzylether, N-halophenylleucoauramine or N-2,4,5-trichlorophenylleucoauramine; xanthene compounds such as rhodamine-B-anilinolactam, rhodamine(p-nitroanilino)lactam, rhodamine B (p-chloroanilino)lactam, 2-benzylamino-6-diethylaminofluorane, 2-anilino-6-diethylaminofluorane, 2-anilino-3-methyl-6-diethylaminofluorane, 2-anilino-3-methyl-6-N-cyclohexyl-N-methylaminofluorane, 2-o-chloroanilino-6-diethylaminofluorane, 2-m-chloroanilino-6-diethylaminofluorane, 2-(3,4-dichloroanilino)-6-diethylaminofluorane, 2-octylamino-6-diethylaminofluorane, 2-dihexylamino-6-diethylaminofluorane, 2-m-trichloromethylanilino-6-diethylaminofluorane, 2-butylamino-3-chloro-6-diethylaminofluorane, 2-ethoxyethylamino-3-chloro-6-diethylaminofluorane, 2-anilino-3-chloro-6-diethylaminofluorane, 2-diphenylamino-6-diethylaminofluorane, 2-anilino-3-methyl-6-diphenylaminofluorane, 2-anilino-3-methyl-5-chloro-6-diethylaminofluorane, 2-anilino-3-methyl-6-diethylamino-7-methylfluorane, 2-anilino-3-methoxy-6-dibutylaminofluorane, 2-o-chloroanilino-6-dibutylaminofluorane, 2-p-chloroanilino-3-ethoxy-6-diethylaminofluorane, 2-anilino-3-methyl-6-N-ethyl-N-isoamylaminofluorane, 2-o-chloroanilino-6-N-ethyl-N-isoamylaminofluorane, 2-anilino-3-pentadecyl-6-diethylaminofluorane, 2-anilino-3-ethyl-6-dibutylaminofluorane, 2-anilino-3-ethyl-6-N-ethyl-N-isoamylaminofluorane, 2-anilino-3-chloro-6-N-ethyl-N-isoamylaminofluorane, 2-anilino-3-methyl-6-N-ethyl-N-γ-methoxypropylaminofluorane, 2-anilino-3-chloro-6-N-hexyl-N-propylaminofluorane or 2-phenyl-6-diethylaminofluorane; thiazine compounds such as benzoyl leucomethylene blue or p-nitrobenzyl leucomethylene blue; and spiropyrane compounds such as 3-methyl-spiro-dinaphthopyrane, 3-ethyl-spiro-dinaphthopyrane, 3,3'-dichloro-spiro-dinaphthopyrane, 3-benzyl-spiro-dinaphthopyrane, 3-methyl-naphtho-(3-methoxybenzo)spiropyrane or 3-propyl-spiro-dibenzopyrane. These are used alone or in combination.

A recording material of the invention can be applied to a pressure-sensitive copying paper, heat-sensitive copying paper, an electro-conductive heat-sensitive recording sheet, a light-sensitive recording sheet, an ultrasonic recording sheet, an electron beam recording sheet, an electrostatic recording sheet, a light-sensitive printing material, a finger print material, a type writer ribbon, an ink for ballpoint pen and a crayon.

A recording material of the invention can be prepared by the following methods.

A pressure-sensitive copying paper of the invention can be any kind or form as disclosed in U.S. Pat. Nos. 2,505,470, 2,505,471, 2,505,489, 2,548,366, 2,712,507, 2,730,456, 2,730,457 and 3,418,250. In general, pressure-sensitive copying papers are composed of a color former sheet and a color developer sheet, each of which has a color former layer and a color developer layer on a paper support, respectively. That is, the color former sheet can be prepared by dissolving an electron donating colorless dye (i.e. color former) in a solvent such as a synthetic oil (e.g. alkylated naphthalene, alkylated diphenyl, alkylated diphenylmethane or alkylate terphenyl), a vegetable oil (e.g. cotton seed oil or castor oil), an animal oil, a mineral oil or a mixture thereof, dispersing it it a binder or microencapsulating it, and coating the dispersion or microcapsules on a support such as paper, plastic film or resin-coated paper. And, the color developer sheet can be prepared by dispersing an electron accepting compound (i.e. color developer) of the invention in a binder such as styrene butadiene latex or polyvinyl alcohol, and then coating the dispersion on a support such as paper, plastic film or resin coated paper. The electron donating colorless dye and electron accepting compound in the invention can be used alone or in combination.

An amount of electron donating colorless dye or electron accepting compound can be varied by a coating thickness, shape or form of copying papers or other conditions, and can be easily determined by one skilled in the art.

A method for microencapsulation includes a method of coacervation of hydrophilic colloid sol as disclosed in U.S. Pat. Nos. 2,800,457 and 2,800,458, and a surface polymerization method as disclosed in British Pat. Nos. 867,797, 950,443, 989,264 and 1,091,076.

A heat-sensitive recording sheet can be prepared by mixing an electron donating colorless dye, an electron accepting compound and if necessary, a thermofusible substance in a solution (a binder solution or dispersion) prepared by dissolving a binder with solvent or dispersing a binder to disperse medium, and further adding an inorganic pigment such as kaolin, talc or calcium carbonate, and then coating the mixture on a support such as paper preferably neutral sizing paper, plastic film or resin coated paper. Where the coating composition is prepared, all components can be mixed simultaneously or separately. In the preparation of the composition, it is more practical that all components are crushed into fine particles and kneaded. A paraffin wax emulsion, a latex type binder, a sensitivity increasing agent, a metal soap, an antioxidant and an ultraviolet ray absorbing agent are added, if necessary, to the composition. The composition can be incorporated into a support instead of coating it.

An approximate amount of each component for the composition of heat-sensitive recording materials is 1 to 2 parts by weight of electron donating colorless dye, 1 to 6 parts by weight of electron accepting compound, 0 to 30 parts by weight of thermofusible substance, 0 to 15 parts by weight of inorganic pigment, 1 to 15 parts by weight of binder and 20 to 300 parts by weight of dispersing medium or solvent.

The electron donating colorless dye is used alone or in combination. The most preferred dispersing medium or solvent is water.

The typical examples of the binder are styrene-butadiene copolymer, alkyd resin, acrylamide copolymer, vinyl chloride-vinyl acetate copolymer, styrene-maleic anhydride copolymer, synthetic rubber, gum arabic, polyvinyl alcohol and hydroxyethyl cellulose. The preferred binder is a water-soluble binder such as gum arabic, polyvinyl alcohol, hydroxymethyl cellulose or carboxymethyl cellulose because water is preferred as a dispersing medium or solvent.

The thermofusible substance is a colorless solid substance at normal temperature, and has a sharp melting point between 70° to 160° C. which is a heating temperature for recording. The typical examples of the thermofusible substance are stearic acid anilide, benzoin, α-naphthol benzoate, β-naphthol-p-methylbenzoate, p-tert-butylphenol phenoxyacetate, p-phenylphenol-p-chlorophenoxyacetate, 4,4'-cyclohexylidenediphenol diacetate, 4,4'-isopropylidenedimethoxybenzene, β-phenylethyl-p-phenylether, 2-p-chlorobenzyloxynaphthalene, 2-benzyloxynaphthalene, 1-benzyloxynaphthalene, 2-phenoxyacetyloxynaphthalene, N-octadecylurea, N-hexadecylurea, N,N'-didodecylurea, phenylcarbamoyloxydodecane, stearic acid amide, behenic acid amide, behenic acid, stearic acid, erucic acid, palmitic acid, methyl p-hydroxybenzoate, diphenyl phthalate, N-myristoyl-p-anisidine, 1-methoxycarbonyl-4-N-stearylcarbamoylbenzene, phenyl-1-hydroxy-2-naphtoate, benzyl-p-benzyloxybenzoate, triphenyl phosphate, p-hydroxydiphenylether, 2,2-bis(4-(β-hydroxyethoxy)phenyl)propane, p-bis(β-hydroxyethoxy)benzene and hydroquinone diacetate.

The invention will be explained in more detail by the following examples, but should not be limited to these examples.

EXAMPLE 1

(1) Preparation of color former sheet

In 30 g of alkylated naphthalene, 1 g of 2-anilino-3-methyl-6-diethylaminofluorane (electron donating colorless dye) was dissolved. The solution was emulsified in 6 g of gelatin and 4 g of gum arabic dissolved in 50 g of water with vigorous stirring to provide oil drops having a diameter of 1 to 10 micron meter, and 250 g of water was added. Small amount of acetic acid was added gradually to adjust a pH of the system to 4, whereby coacervation occured to form capsule walls of gelatin and gum arabic around oil droplets. Formalin was added and pH of the system was adjusted to 9 to harden the capsule walls. Thus prepared microcapsule dispersion was coated on paper and then dried to provide a color former sheet.

(2) Preparation of color developerr sheet

In 200 g of a 5% aqueous solution of polyvinyl alcohol, 20 g of 4-α-naphthyloxysulfonylphenol (electron accepting compound) was dispersed and 20 g of kaolin (Georgia Kaolin) was dispersed to prepare a coating composition. The composition was coated on paper and dried to provide a color developer sheet.

Thus prepared color former sheet and color developer sheet were contacted under pressure, whereby black color images were immediately formed. The images had high color density and high light-resistance and heat-resistance.

EXAMPLE 2

5 g of 2-anilino-3-methyl-6-N-methyl-N-cyclohexylaminofluorane (electron donating colorless dye) was dispersed in 50 g of a 5% aqueous solution of polyvinyl alcohol (saponification degree: 99%, polymerization degree: 1000) for overnight by means of a ball mill, 10 g of 4-α-naphthyloxysulfonylphenol (electron accepting compound) was dispersed in 100 g of a 5% aqueous solution of polyvinyl alcohol for overnight by means of a ball mill.

Two dispersions were mixed and 20 g of kaolin (Georgia Kaolin) was dispersed in the mixture, and then 5 g of a 50% dispersion of paraffin wax (trade name: Cellosol #428 manufacture by Chukyo Yushi Co., Ltd.) was added to prepare a coating composition. The composition was coated in a solid coating amount of 6 g/m$^2$ on paper having a weight of 50 g/m$^2$, and dried at 60° C. for 1 minute to obtain a coated paper.

The coated paper was heated under heating energy of 40 mJ/mm$^2$ on a facsimile to form black color images having excellent light-fastness and heat resistance.

EXAMPLE 3

The same procedure as in Example 2 was repeated except that 5 g of 2-o-chloroanilino-6-diethylaminofluorane was used instead of electron donating colorless dye in Example 2 and that 6 g of 4-phenoxysulfonyl-1-naphthol and 4 g of 2,2-bis(4-hydroxyphenyl)propane were used instead of electron accepting compound in Example 2.

Thus obtained coated paper was heated on a facsimile to form black color images.

EXAMPLE 4

1.5 g of 2-anilino-3-chloro-6-diethylaminofluorane (electron donating colorless dye) and 0.5 g of 4-p-tolyloxysulfonylphenol (electron accepting compound) were dissolved in 100 ml of acetone, and coated in a coating amount (solid content) of 1.0 g/m$^2$. The color density of color images formed on the coated paper was 0.73.

EXAMPLE 5

A mixture of electron donating colorless dyes, 3 g of 2-anilino-3-methyl-6-N-methyl-N-cyclohexylaminofluorane and 2 g of 2-anilino-3-chloro-6-diethylaminofluorane, was dispersed in 50 g of a 5% aqueous solution of polyvinyl alcohol (saponification degree: 99%, polymerization degree: 1000) for overnight by means of a ball mill.

On the other hand, 10 g of 4-β-naphthyloxysulfonylphenol was dispersed in 100 g of a 5% aqueous solution of polivinyl alcohol for overnight.

Further, 10 g of 2-benzyloxynaphthalene (heat-fusible compound) was dispersed in 100 g of a 5% aqueous solution of polyvinyl alcohol for overnight.

After mixing the aformentioned three dispersions, 20 g of kaoline was added and well mixed. Then, 5 g of paraffin wax (trade name: Cellosol #428 manufactured by Chukyo Yushi Co., Ltd.) was added to prepare a coating composition. The composition was coated in a solid coating amount of 6 g/m$^2$ on neutral sizing paper having a weight of 50 g/m$^2$, and dried at 60° C. for 1 minute to obtain a coated paper.

The coated paper was heated under heating energy of 40 mJ/mm$^2$ on a facsimile to form black color image.

COMPARATIVE EXAMPLE 1

The same procedure as in Example 4 was repeated except that 0.5 g of 2,2-bis(4-hydroxyphenyl)propane was used instead of electron accepting compound in Example 3. The color density of color images was 0.55.

COMPARATIVE EXAMPLE 2

The same procedure as in Example 4 was repeated except that 0.5 g of zinc 3,5-bis(α-methylbenzyl)salicylate was used instead of electron accepting compound in Example 3. The color density of color images was 0.50.

It is apparent from the comparison of Example 4 with Comparative Examples 1 and 2 that the electron accepting compound of the invention can provide higher color properties.

While the invention has been described in detail and with reference to specific embodiments thereof, it will be apparent to one skilled in the art that various changes and modifications can be made therein without departing from the spirit and scope thereof.

What is claimed is:

1. A recording material, comprising:

a support base;

an electron donating colorless dye; and an electron accepting compound, said electron accepting compound being a phenol or naphthol compound having, as a substituent, an aryloxysulfonyl group which can be substituted or an alkoxysulfonyl group which can be substituted, wherein the electron accepting compound is represented by the following formula (I) or (II)

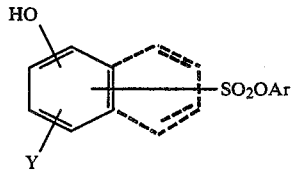

(I)

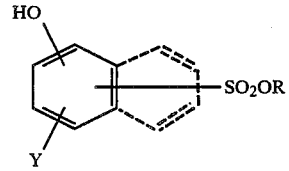

(II)

wherein Y is a hydrogen atom, an alkyl group, an aryl group, a halogen atom or an electron attracting group, Ar is a phenyl or naphthyl group which can be substituted, R is an alkyl or aralkyl group which can be substituted, and the aromatic ring substituted with a hydroxyl group can be a benzene ring or a naphthalene ring.

2. A recording material, as claimed in claim 1, wherein the electron accepting compound is represented by the following formula (III)

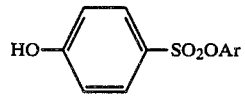

wherein Ar is a phenyl or naphthyl group which can be substituted with an alkyl group having 1 to 4 carbon atoms, a chlorine atom, an alkoxy group having 1 to 4 carbon atoms, a hydroxy group, an acyl group having 1 to 8 carbon atoms, a substituted carbamoyl group having 2 to 9 carbon atoms, a sulfonyl group having 1 to 8 carbon atoms or a substituted sulfamoyl group having 1 to 8 carbon atoms.

* * * * *